United States Patent [19]

Smith et al.

[11] Patent Number: 4,800,737

[45] Date of Patent: Jan. 31, 1989

[54] AUTOMOTIVE AIR CONDITIONING SYSTEM ACCUMULATOR WITH REFRIGERANT PROCESSING CARTRIDGE INCLUDING EVAPORATOR PRESSURE REGULATOR

[75] Inventors: Michael D. Smith, Westland; Norman H. Dolinski, Grosse Point Woods; Jayendra J. Amin, Pontiac, all of Mich.

[73] Assignee: Ford Motor Company, Dearborn, Mich.

[21] Appl. No.: 39,544

[22] Filed: Apr. 17, 1987

[51] Int. Cl.[4] ..... F25B 43/00

[52] U.S. Cl. ..... 62/503; 62/217; 62/474

[58] Field of Search ..... 62/474, 503, 217

[56] References Cited

U.S. PATENT DOCUMENTS

| | | | |
|---|---|---|---|
| 1,672,571 | 6/1928 | Leonard | 418/73 |
| 2,608,269 | 8/1952 | Briggs | 62/405 |
| 3,525,234 | 8/1970 | Widdowson | 62/474 |
| 3,633,377 | 1/1972 | Quick | 62/192 |
| 3,708,998 | 1/1973 | Scherer et al. | 62/210 |
| 3,858,407 | 1/1975 | Schumacher | 62/217 |
| 3,939,669 | 2/1976 | Schumacher | 62/217 |
| 3,942,332 | 3/1976 | Schumacher | 62/217 |
| 3,955,375 | 5/1976 | Schumacher | 62/217 |
| 4,173,440 | 11/1979 | Libis | 418/84 |
| 4,289,461 | 9/1981 | van Oorschot et al. | 418/84 |
| 4,331,001 | 5/1982 | Jones | 62/503 |
| 4,474,035 | 10/1984 | Amin et al. | 62/503 |
| 4,509,340 | 4/1985 | Mullally et al. | 62/503 |
| 4,553,906 | 11/1985 | Boller et al. | 417/295 |

FOREIGN PATENT DOCUMENTS

| | | |
|---|---|---|
| 2720214 | 1/1977 | Fed. Rep. of Germany . |
| 3506433 | 10/1985 | Fed. Rep. of Germany . |
| 1512507 | 6/1978 | United Kingdom . |

*Primary Examiner*—Ronald C. Capossela

*Attorney, Agent, or Firm*—Jerome R. Drouillard; Roger L. May

[57] ABSTRACT

An accumulator for use in an air conditioning system for an automotive vehicle includes a refrigerant processing cartridge with an outer casing, a desiccant, a filter, a separator, and a regulator for controlling the pressure of the refrigerant within the air conditioning system.

10 Claims, 3 Drawing Sheets

AUTOMOTIVE AIR CONDITIONING SYSTEM ACCUMULATOR WITH REFRIGERANT PROCESSING CARTRIDGE INCLUDING EVAPORATOR PRESSURE REGULATOR

BACKGROUND OF THE INVENTION

1. Field of the Invention

This invention relates to a refrigerant processing cartridge for the accumulator of an automotive air conditioning system. The cartridge has an integral evaporator pressure regulator, a desiccant chamber, and refrigerant and oil filtering capability.

2. Disclosure Information

Automotive air conditioning systems typically use a fluorocarbon compound as a refrigerant. An air conditioning compressor in the system compresses the refrigerant for delivery to an air conditioning condenser where the state of the refrigerant changes from a gas to a liquid. The outlet side of the condenser is connected via an expansion device to an evaporator, where the refrigerant changes state from a liquid to a gas. An air blower circulates air over the evaporator to the vehicle passenger compartment causing heat transfer to occur from the ambient air to the evaporator.

The outlet side of the evaporator in certain air conditioning systems is connected to an accumulator which contains a liquid-gas separator. The separator causes liquid components of the refrigerant to be separated from the gaseous component before the gaseous component is returned to the compressor. The accumulator also provides for recovery of lubricating oil contained in the refrigerant gas and for returning a metered amount of lubricating oil to the inlet side of the compressor for lubrication purposes. Because the accumulator is connected to the inlet side of the compressor, the reduced absolute pressure in the accumulator causes a portion of the liquified refrigerant to return to the gaseous state, whereupon it is returned to the inlet side of the compressor. An example of a prior art air conditioning accumulator is shown in FIG. 1 of the specification and described in U.S. Pat. No. 4,474,035, which is assigned to the assignee of the present invention.

The amount of liquid refrigerant retained in the accumulator of the present invention depends upon the conditions under which the system operates. Regardless, however, of the amount of liquid retained in the accumulator, the accumulator functions to allow only vapor to be returned to the compressor together with a very small metered amount of lubricating oil.

Prior art refrigeration units employing fluid compressors requiring accurate control frequently need both high pressure relief means and low pressure or low temperature electrical cut-off means. The latter involves deengergizing the compressor from its drive means if the pressure or temperature of the refrigerant gas falls below a predetermined value, such as when the temperature or pressure of the evaporator falls below a given level. Automobile air conditioning systems commonly use a refrigerant compressor driven by the automobile engine through an electromagnetic clutch with a coil. In one form of electromagnetic compressor clutch system a switch is provided having a refrigerant-filled capillary tube whose one end senses evaporator temperature. The other end of the tube connects with a refrigerant-filled bellows portion which includes an electrical switch. When the evaporator temperature falls below a predetermined value, the clutch of the compressor is deactivated. Upon the evaporator temperature increasing the clutch is reactivated. The cycling of the clutch on-and-off maintains the evaporator temperature above 32° F. to prevent freezing of the evaporator.

Cycling of an air conditioning compressor clutch in order to prevent icing of the evaporator may produce undesirable vehicle surge because the on-and-off cycling of the compressor causes a fluctuation in the torque available from the vehicle's engine. If, on the other hand, an evaporator pressure control is employed to throttle the flow of refrigerant through the system, the need for excessive cycling of the compressor clutch may be eliminated. In the event that the refrigerant pressure control is housed within an accumulator according to the present invention, the accumulator will perform the function of both an accumulator and a pressure regulator.

Designers have employed a variety of schemes for arranging accumulators or oil separators for use with compressors. In the usual case, the working fluid of the system is circulated to the accumulator tank, where the vapor components are caused to rise in the tank and are drawn off through a filter. In some refrigerant systems all of the vapor passing from the accumulator or separator must first pass through the filter element. The following U.S. patents generally describe such types of accumulators or separators: U.S. Pat. Nos. 1,672,571; 3,633,377; 4,173,440; 4,289,461; and 4,553,906. Further, British Pat. No. 1,512,507 and German Pat. Nos. 2,720,214 and 3,506,433 describe similar systems for separating and filtering oil from the working fluid of a compressor. Each of these devices employs a single flow path for the working fluid being returned to the compressor. This is disadvantageous inasmuch as a blockage of the single flow path will cause failure of the refrigerating system.

U.S. Pat. No. 2,608,269 describes an oil separator for a refrigeration system in which all of the gases and oil entering the oil separator must first pass through a solid adsorbent block and then through a matted mesh strainer before passing out of the separator. This type of system as well as systems described in U.S. Pat. Nos. 4,331,001 and 4,509,340 suffer from a common deficiency inasmuch as the refrigerant may be subjected to an excessively high pressure drop occasioned by the requirement of passage along a single flow path through not only a screen element but also through a desiccant or dehydrator material. The latter two patents describe automotive air conditioning accumulator assemblies in which a cartridge including a desiccant material has an outlet extending from the cartridge at a right angle to the axis of the accumulator. These cartridges are not well suited, therefore, to automated assembly of the accumulators because the cartridges are not susceptible to axial insertion into the upper portion of the cylindrical housing of the accumulator.

Various types of evaporator pressure control valves have been used in conjunction with automotive air conditioning systems. U.S. Pat. No. 3,708,998 discloses a valve which is mounted externally of the accumulator. U.S. Pat. Nos. 3,858,407; 3,939,669; 3,942,332; and 3,955,375 each disclose an accumulator having an evaporator pressure regulator built into the outer casing of the accumulator.

It is an object of the present invention to provide an accumulator with a refrigerant processing cartridge including a pressure regulator for regulating the pressure within the evaporator of the air conditioning system.

It is yet another object of the present invention to provide an accumulator having a replaceable refrigerant processing cartridge with a pressure regulator, which cartridge may be replaced in the event that the pressure regulator ceases to perform properly.

It is yet another object of the present invention to provide an accumulator having a refrigerant processing cartridge with a pressure regulator, which cartridge may easily be assembled into the accumulator by automated assembly techniques.

It is yet another object of the invention to provide a refrigerant processing cartridge for use in the accumulator of an air conditioning system wherein the cartridge has a dual flow path for the refrigerant in order that the refrigerant will not be subjected to an unduly great flow restriction on its way through the accumulator.

It is an advantage of the present invention that a refrigerant processing cartridge equipped with a pressure control device according to this invention may be used to build families of refrigerant accumulators with varying performance characteristics through the substitution of cartridges having different pressure control settings.

Other objects, features and advantages of the present invention will become apparent through the following description of the invention.

SUMMARY OF THE DISCLOSURE

In accordance with an embodiment of this invention, an accumulator for use in an air conditioning system for an automotive vehicle with the system including refrigerant and a refrigerant circuit having a compressor with an inlet port, and a condenser and an evaporator arranged in a series relationship on the high pressure side of the compressor, comprises a housing including upper and lower portions joined together to define a closed chamber with the accumulator housing having upper and lower housing walls. An inlet tube extends through the upper wall of the accumulator and communicates with the outlet side of the evaporator. An outlet tube extends through the upper wall of the accumulator housing and communicates with the inlet port of the compressor. The accumulator further comprises a refrigerant processing cartridge positioned within the housing with the cartridge comprising an outer casing having upper and lower casing walls, drier means for removing moisture from the refrigerant, filter means for removing particulate matter from the refrigerant, and pressure regulator means for regulating the pressure of the refrigerant within the system. The pressure regulator means may comprise a bellows and an associated valve, including a seat and a disc which is moved relative to the seat by the action of the bellows. The pressure regulator means may comprise a pressure sensitive linear actuator which is responsive to either the pressure at the inlet port of the compressor, or to the pressure at the outlet of the evaporator.

A dual flow path refrigerant processing cartridge according to the present invention therefore comprises a casing, filter means for removing particulate matter from the refrigerant, regulator means for regulating the pressure of the refrigerant within the evaporator, and drier means for removing moisture from the refrigerant, with the filter and drier means disposed within the casing so as to comprise a first flow path for the refrigerant in which refrigerant exiting the accumulator must pass through filter means, drier means, and regulator means, and a second flow path in which refrigerant leaving the accumulator must pass only through filter means and regulator means.

DESCRIPTION OF THE PREFERRED EMBODIMENTS

Figure 2:
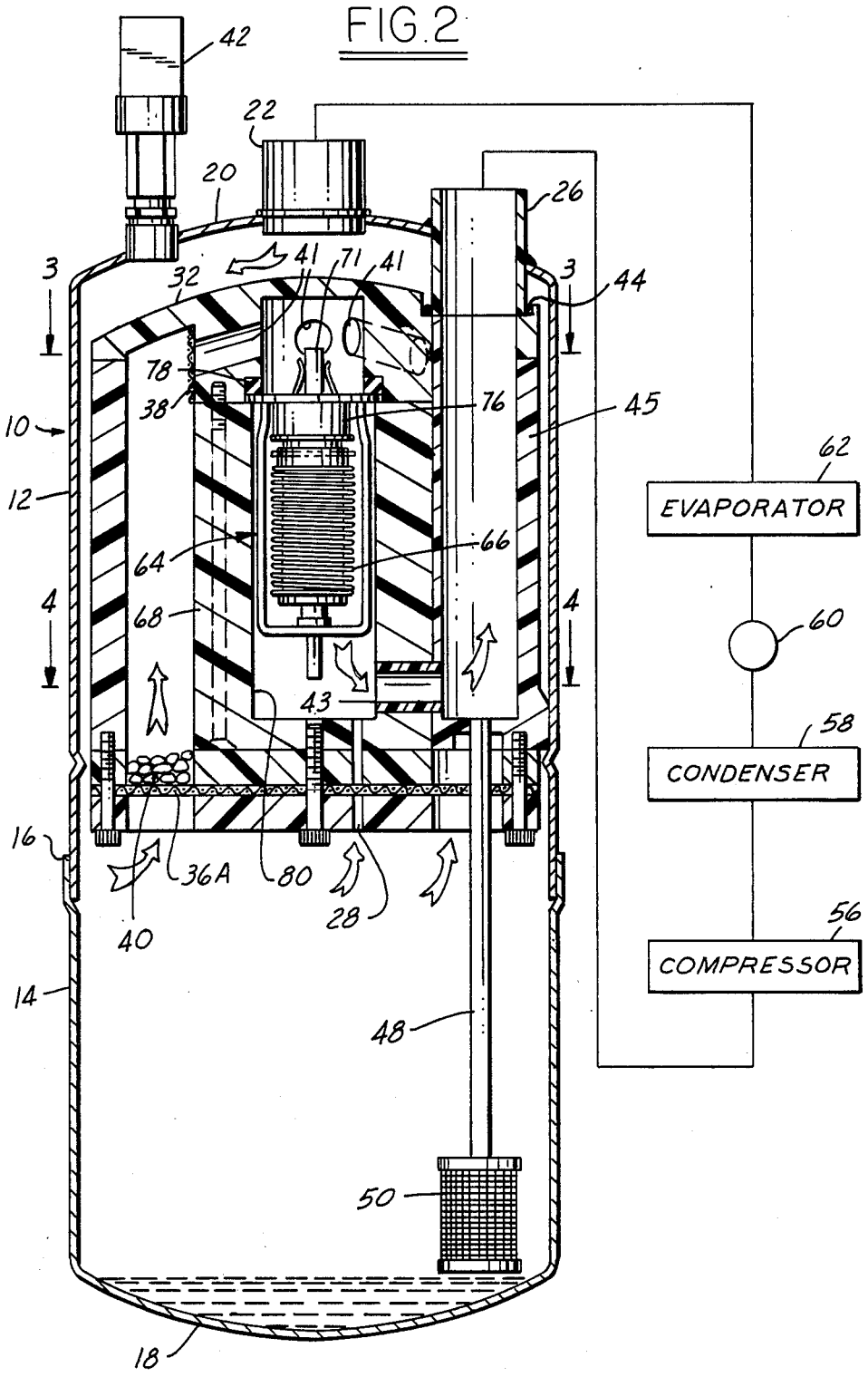
FIG. 2 is a cut away view of an accumulator according to the present invention, as well as a schematic representation of an air conditioning system suitable for use with an accumulator according to the present invention. This view is taken along the line 2—2 of FIG. 1.

As shown in FIG. 2, an accumulator according to the present invention includes cylindrical housing 10 comprising upper portion 12 which includes upper housing wall 20, and lower portion 14 which includes lower housing wall 18. The upper and lower cylindrical portions of the housing are joined by welded joint 16. Those skilled in the art will appreciate in view of this disclosure that joint 16 could comprise a brazed or welded joint, or a threaded or bolted joint or any other type of suitable joint. In the event that it is desired to manufacture an easily rebuildable accumulator, joint 16 may comprise a threaded or bolted joint which will allow the refrigerant processing cartridge to be readily removed from the accumulator for renewal. Those skilled in the art will further appreciate in view of this disclosure that cylindrical housing 10 could be fabricated of various materials such as ferrous and nonferrous metals, plastics, composite materials, or other types of materials known to those skilled in the art. Those skilled in the art will further appreciate in view of this disclosure that the accumulator housing could have a geometric shape other than that of a cylinder. Other shapes may be appropriate for other applications of the present invention.

As further shown in FIG. 2, an accumulator according to the present invention is provided with inlet tube 22 which is joined with upper housing wall 20 at a location proximate the geometric center of the upper wall. Inlet tube 22 conveys refrigerant from evaporator 62 into the accumulator. Although FIG. 2 shows evaporator 62, condenser 58, expansion orifice 60 and compressor 56 of a conventional air conditioning system, those skilled in the art will appreciate in view of this disclosure that an accumulator according to the present invention may be used in other types of air conditioning systems and at other locations within such systems.

Figure 4:
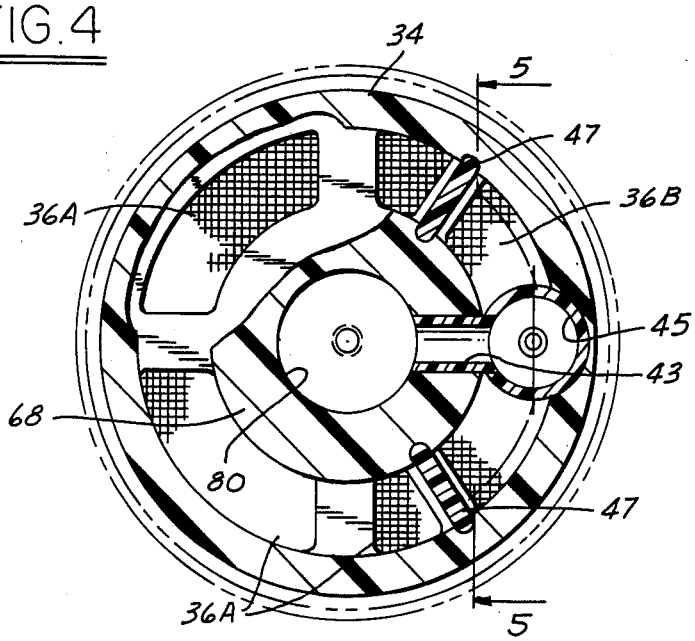
FIG. 4 is a cross sectional view, partially broken away, of an accumulator according to the present invention taken along the line 4—4 of FIG. 2.

An accumulator according to the present invention may be joined with compressor 56 of the air conditioning system illustrated in FIG. 2 by means of outlet tube 26 which extends through upper housing wall 20 at a location which is adjacent to the inner wall of the housing. As shown in FIGS. 2 and 4, an axially insertable refrigerant processing cartridge positioned within the housing is operatively connected with outlet tube 26.

The refrigerant processing cartridge shown within the accumulator of FIG. 2 comprises a generally cylindrical outer casing including a cylindrical casing side wall 34 and a domed upper casing wall 32 which comprises a convex baffle. The baffle functions as separator means for promoting separation of the liquid and vapor components of the refrigerant entering the accumulator through inlet tube 22.

The outer casing of the cartridge additionally includes a lower casing wall which is divided into strainer sections 36A and 36B (FIG. 4). Each strainer section functions as a filter to remove particulate material from the flowing refrigerant. In combination, strainer sections 36A and 36B comprise a first strainer element extending across substantially the entire lower portion of the casing. Strainer section 36A comprises a portion of a first flow path through which refrigerant flows through both the strainer and also through desiccant 40 and then through pressure regulator 64. (See FIG. 2). Strainer section 36B (FIG. 4) comprises a portion of a second flow path which permits refrigerant to flow into outlet tube 26 after passing through the pressure regulator assembly, without first passing through desiccant material 40. In usual fashion, the desiccant material is intended to remove moisture residing in the circulating refrigerant.

Figure 1:
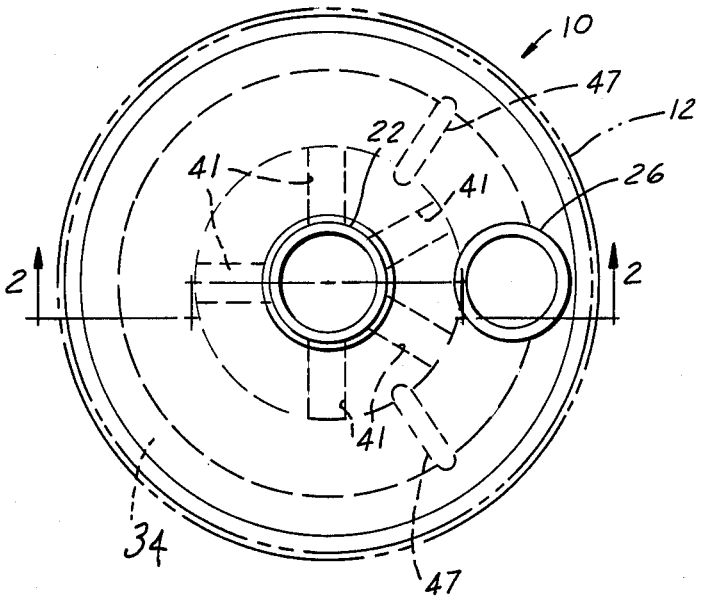
FIG. 1 is a plan view of an automotive air conditioning accumulator according to the present invention.
Figure 3:
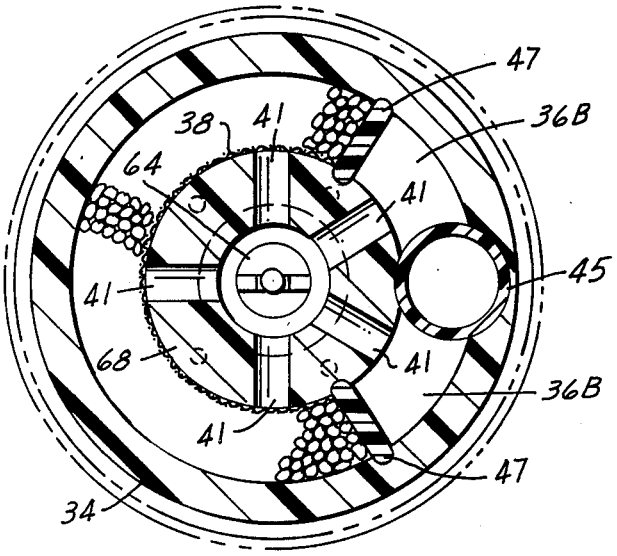
FIG. 3 is a cross sectional view of an accumulator according to the present invention taken along the line 3—3 of FIG. 2.

As shown in FIGS. 2 and 3, second strainer element 38 contains desiccant material 40 within the cartridge by preventing the dessicant from migrating into radial passages 41. Thus, strainer section 36A and second strainer element 38 comprise filter means for retaining desiccant 40 within the cartridge casing. First strainer element 36A and second strainer element 38 thereby define a portion of a first flow path in which refrigerant will flow through both strainer elements and desiccant material 40 before flowing into radial passages 41 prior to flowing through pressure regulator 64 and then out through outlet tube 26. According to this first flow path, refrigerant impinging upon the domed upper casing wall 32 is separated into gaseous and liquid fractions and then flows up through section 36A of the first strainer element, and then through or over desiccant pellets 40. Flow continues through second strainer element 38, through radial passages 41, down through the pressure regulator, out through port 43, and up through standpipe 45 into outlet tube 26.

As previously noted, a second refrigerant flow path is partially defined by strainer section 36B. Refrigerant flowing through strainer section 36B flows upward through two passages defined by radial walls 47, the outer surface of standpipe 45, and casing side wall 34. The refrigerant continues through radial passages 41 and then flows down through pressure regulator 64, out through port 43, and up through standpipe 45 into outlet tube 26. Note that refrigerant passing along this second flow path does not pass through desiccant material 40. Accordingly, because the refrigerant is not caused to flow through the desiccant material, the flow of refrigerant will not be hampered even in the event that either the desiccant or filter 38 or 36A becomes blocked to flow due to contamination. This fact is important because the performance of the air conditioning system will be maintained for a longer period of time even with a contaminated filter system. Another advantage of the dual flow path system resides in the fact that operation of the system with little or no refrigerant flow will likely cause damage to the compressor; this possibility is limited by a refrigerant processing cartridge according to the present invention.

The likelihood of damaging an air conditioning system equipped with an accumulator according to the present invention by operating the system at a reduced refrigerant level is further mitigated by the presence of bypass 28. This bypass comprises an orifice between the lower casing wall of the cartridge and the central bore in which the pressure regulator is mounted. While the system is under operation, a small quantity of refrigerant will be allowed to bleed through bypass 28 without passing through either the filter, or the desiccant, or the pressure regulator. In the event that the system is operated such that pressure switch 42 is employed for the purpose of disengaging compressor 56 when the pressure within the accumulator goes below a predetermined minimum level, such as will occur if the refrigerant charge is lost, bypass 28 will enable the low pressure condition to be more readily communicated to pressure switch 42.

Figure 5:
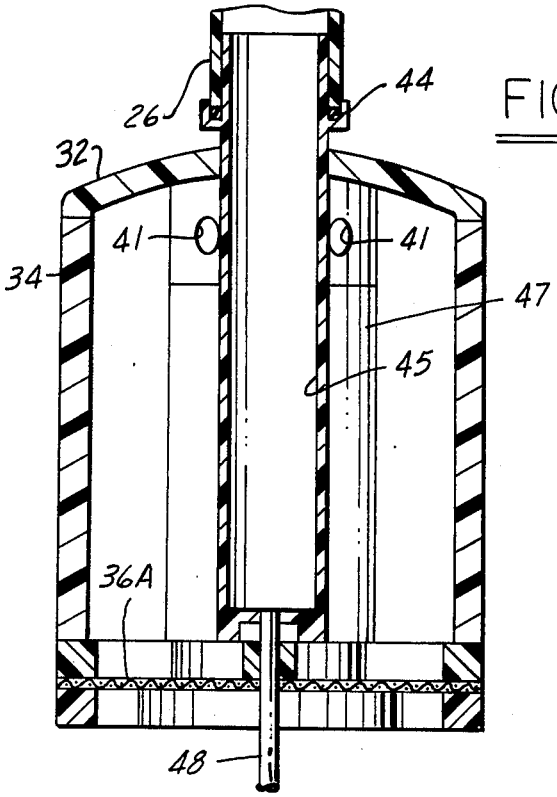
FIG. 5 is a cross sectional view of an accumulator according to the present invention taken along the line 5—5 of FIG. 4.

The details of standpipe 45 are shown with particularity in FIGS. 2 and 5. Standpipe 45 is equipped with O-ring seal 44 which slidingly accepts outlet tube 26 during assembly of the accumulator. Accordingly, standpipe 45 and O-ring seal 44 comprise a port for sealingly receiving outlet tube 26 within the refrigerant processing cartridge. In a broader sense, standpipe 45 and O-ring seal 44 comprise means for connecting the refrigerant processing cartridge with outlet tube 26.

Those skilled in the art will appreciate in view of this disclosure that the desiccant contained within a refrigerant processing cartridge according to the present invention could comprise either a pellet or a porous cake form of desiccant, or any other type of desiccant suitable for use in a refrigerant processing cartridge.

Figure 6:
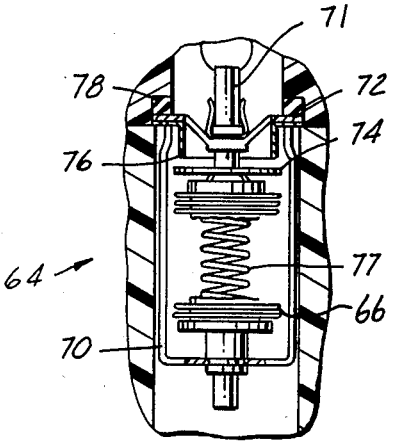
FIG. 6 is an enlarged sectional view of the pressure regulator portion of the accumulator shown in FIG. 2.

The construction and operation of the pressure regulator may be understood with reference to FIGS. 2 and 6. As shown in FIG. 2, pressure regulator 64 is situated within central bore 80 which is formed in regulator cylinder 68. The upper end of regulator cylinder 68, as shown in FIG. 2, also serves to retain the pressure regulator in an abutting relationship with sealing ring 78. Accordingly, all refrigerant flowing through radial passages 41 must pass through the pressure regulator; sealing ring 78 prevents refrigerant from bypassing the pressure regulator. FIG. 2 illustrates that refrigerant passing through pressure regulator 64 must first pass radially through radial passages 41 into central bore 80 and then axially through the regulator, and then radially out of said central bore through outflow port 43.

Additional details of the pressure regulator are shown in FIG. 6. Bellows 66 and valve disc 74 are mounted to a common valve stem, 71. Bail 70 serves to maintain bellows 66 and valve disc 74 in contact with valve seat 76. Valve disc 74 is clamped against valve seat 76 by bellows 66, which includes coil compression spring 77. Although bellows 66 is preferably constructed of corrugated copper, other configurations and materials could be employed in the practice of the present invention, it being understood that the illustrated bellows comprises but one member drawn from a class of pressure sensitive linear actuator devices.

Pressure regulator 64 responds to evaporator pressure as follows. Because bellows 66 is responsive to the pressure of refrigerant prevailing at the inlet port of compressor 56, the bellows will "grow", or expand in length when the pressure at the inlet to the compressor decreases. This expansion in the length of the bellows will cause valve disc 74 to move toward valve seat 76, whereby the flow of refrigerant through the air conditioning system will be reduced. This will cause the pressure within evaporator 62 to increase. As the pressure differential across valve disc 74 increases, valve disc 74 is moved away from valve seat 76, allowing the pressure at the inlet of the compressor to increase. This will cause the bellows to contract in length, whereby the valve disc will be allowed to move further away from the valve seat, and as this occurs the flow through the system will increase as the pressure in the evaporator decreases. Accordingly, the pressure regulator functions as a closed loop controller for evaporator pressure. Because the pressure regulator controls the pressure within the evaporator, and thus, its temperature, icing of the evaporator will be prevented without unnecessary cycling of the compressor. Those skilled in the art will appreciate in view of this disclosure that bellows 66 may be evacuated and then sealed, or it may be filled with refrigerant or other temperature or pressure sensitive substances and then sealed. In either event, the control characteristics of the bellows may be tailored to the requirements of any particular air conditioning system.

Figure 7:
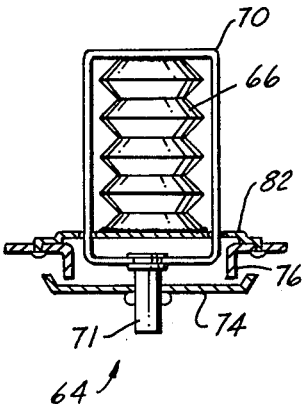
FIG. 7 is an enlarged sectional view of an alternative pressure regulator configuration.

Those skilled in the art will appreciate in view of this disclosure that the bellows and associated valve of the pressure regulator could be oriented within the cartridge such that the pressure within the evaporator acts directly upon the bellows. This would require that the position of the bellows be reversed from that shown in FIG. 2, so that the bellows is upstream from the valve mechanism. In any event, the pressure regulator will function as previously described to control the pressure developed within the air conditioning system in general, and the evaporator in particular. An example of an inverted bellows design is shown in FIG. 7. In this case, the bellows extends between the upper end of bail 70 and the top of bellows support 82. Valve stem 71 and valve disc 74 are attached to the lower end of bail 70. Valve disc 74 controls the flow of refrigerant in concert with valve seat 76. This configuration functions in a manner which is fundamentally like that of the previously described configuration, except that the pressure within the evaporator acts directly upon bellows 66, rather than indirectly.

A refrigerant processing cartridge according to the present invention is axially insertable within the accumulator described herein because the cartridge may be slidably engaged with outlet tube 26. This is important because an accumulator according to the present invention could readily be assembled using automated techniques.

Those skilled in the art will appreciate in view of this disclosure that the outer casing of a refrigerant processing cartridge according to the present invention, including the strainer elements, could be fabricated of various materials such as ferrous or nonferrous metals, plastic materials, or various composite materials.

Lubricating oil is allowed to circulate with the refrigerant of most conventional automotive air conditioning systems. Accordingly, an accumulator according to this invention preferably includes aspirator tube 48 including aspirator tube strainer 50. Aspirator tube 48 allows droplets of liquid refrigerant and oil to be entrained into the flow of refrigerant leaving the accumulator through outlet tube 26.

Advantageously, an accumulator according to the present invention is rebuildable. Rebuilding of the accumulator could involve disassembly of cylindrical housing 10 followed by removal of the spent or contaminated refrigerant processing cartridge, followed by insertion of a new refrigerant processing cartridge.

In sum, a refrigerant processing cartridge according to the present invention will provide dual flow paths with filter means for removing particulate matter from the refrigerant. The first of said flow paths also comprises drier or desiccant means disposed within the cartridge so as to comprise a flow path in which the refrigerant exiting the accumulator must pass through both filter and drier means. In any event, all refrigerant passing through the accumulator must pass through the pressure regulator. The dual path aspect of the present invention is important because it has been found that prior art accumulators which require refrigerant leaving the accumulator to flow serially through filter means and then through a desiccant sometimes impose an undesirably great pressure restriction upon the flow of the gaseous refrigerant. An accumulator according to the present invention will not subject the flowing refrigerant to unduly great flow restriction. This aspect of the present invention is important because operation of the pressure regulator will not be hindered by large changes in pressure due solely to contamination of the desiccant. Further, the positioning of desiccant within a cartridge elevated above the liquid within the accumulator assures that the desiccant will be more efficiently utilized, as it will not be submerged within the liquid refrigerant and lubricating oil.

The foregoing description presents the presently preferred embodiments of this invention. Alterations and modifications may occur to those skilled in the art, which alterations and modifications will come within the spirit and scope of the following claims.

We claim:

1. An accumulator for use in an air conditioning system for an automotive vehicle, said system including refrigerant and a refrigerant circuit having a compressor with an inlet port, a condenser, an expansion device, and an evaporator arranged in a series relationship with the high pressure side of the compressor, said accumulator comprising:

a housing comprised of upper and lower portions joined together to define a closed chamber, said accumulator housing having an upper housing wall and a lower housing wall;

an inlet tube extending through said upper wall, said inlet tube communicating with the outlet side of said evaporator;

an outlet tube extending through said upper wall of said housing, said outlet tube communicating with the inlet port of said compressor; and a refrigerant processing cartridge positioned within said housing, said cartridge comprising:

an outer casing having upper and lower casing walls;

drier means for removing moisture from said refrigerant;

filter means for removing particulate matter from said refrigerant; and pressure regulator means for regulating the pressure of said refrigerant within said air conditioning system.

2. An accumulator according to claim 1 wherein said pressure regulator means comprises a pressure sensitive linear actuator and an associated valve operated by said actuator for controlling the flow of said refrigerant through said accumulator.

3. An accumulator according to claim 2 wherein said actuator is responsive to the pressure of said refrigerant prevailing at the inlet port of said compressor.

4. An accumulator according to claim 2 wherein said actuator is responsive to the pressure of said refrigerant prevailing at the outlet side of said evaporator.

5. An accumulator according to claim 2 wherein said valve comprises a seat and a disc which is moved relative to said seat by the action of said actuator.

6. An accumulator for use in an air conditioning system for an automotive vehicle, said system including refrigerant and a refrigerant circuit having a compressor with an inlet port, and a condenser, an expansion device, and an evaporator arranged in a series relationship on the high pressure side of the compressor, said accumulator comprising:

a cylindrical housing comprised of upper and lower cylindrical portions joined together in abutting relationship to define a closed cylindrical chamber, with said accumulator housing having an upper housing wall and a lower housing wall;

an inlet tube extending through said upper wall at a location proximate the geometric center of said upper wall, said inlet tube communicating with the outlet side of said evaporator;

an outlet tube extending through said upper wall of said housing adjacent the inner wall of said housing, said outlet tube communicating with the inlet port of said compressor; and an axially insertable refrigerant processing cartridge positioned within said housing, said cartridge comprising:

a generally cylindrical outer casing having a domed upper wall comprising a convex baffle maintained in close proximity to said inlet tube, and a lower wall;

a port for sealingly receiving said outlet tube within said cartridge;

desiccant material contained within said outer casing;

means for retaining said casing within said upper cylindrical portion and pressure regulator means for regulating the pressure of said refrigerant within said evaporator, with said pressure regulator means comprising: (i) a bellows responsive to the pressure of said refrigerant prevailing at the inlet port of said compressor, and (ii) a valve operated by said bellows for controlling the flow of said refrigerant through said accumulator, wherein said valve comprises a seat and a disc which is moved relative to said seat by the action of said bellows.

7. A dual flow path refrigerant processing cartridge for use in the accumulator of an air conditioning system for an automotive vehicle, said system including refrigerant and a refrigerant circuit having a compressor, a condenser, an expansion device, and an evaporator, having an inlet side and an outlet side, arranged in a series relationship on the high pressure side of the compressor, said cartridge comprising:

a casing;

filter means for removing particulate matter from said refrigerant;

regulator means for regulating the pressure of said refrigerant within said evaporator; and drier means for removing moisture from said refrigerant, with said filter and drier means disposed within said casing so as to comprise a first flow path for said refrigerant in which refrigerant exiting said accumulator must pass through said filter means, said drier means, and said regulator means, and a second flow path in which refrigerant leaving said accumulator must pass through only said filter means and said regulator means.

8. A dual flow path refrigerant processing cartridge according to claim 7 wherein said pressure regulator means comprises: (i) a bellows responsive to the pressure of said refrigerant prevailing at the inlet port of said compressor, and (ii) a valve operated by said bellows for controlling the flow of said refrigerant through said accumulator.

9. A dual flow path refrigerant processing cartridge according to claim 7 wherein said pressure regulator means comprises: (i) a bellows responsive to the pressure of said refrigerant prevailing at the outlet side of said evaporator, and (ii) a valve operated by said bellows for controlling the flow of said refrigerant through said accumulator.

10. A dual flow path refrigerant processing cartridge according to claim 7 wherein said pressure regulator means is situated within a central bore formed in a regulator cylinder housed within said cartridge, so that refrigerant passing through said regulator must first pass radially into said central bore, and then axially through said regulator, and then radially out of said central bore.

* * * * *